United States Patent [19]

Lindquist

[11] 4,314,622

[45] Feb. 9, 1982

[54] EXTENSION BOOM FOR TRACTORS HAVING BACK HOE ATTACHMENTS

[76] Inventor: William W. Lindquist, 190 Clarencedale Ave., Youngstown, Ohio 44512

[21] Appl. No.: 134,189

[22] Filed: Mar. 26, 1980

[51] Int. Cl.[3] ..... B66F 11/04

[52] U.S. Cl. .....182/2; 212/266

[58] Field of Search .....182/2; 52/118, 212/266; 267; 232; 244

[56] References Cited

U.S. PATENT DOCUMENTS

| | | | |
|---|---|---|---|
| 3,286,855 | 11/1966 | Bill | 182/2 |
| 3,291,253 | 12/1966 | Wible | 182/2 |
| 3,448,827 | 6/1969 | Clark | 182/2 |
| 3,534,832 | 10/1970 | Rediske | 182/2 |
| 3,759,399 | 9/1973 | Glass | 212/266 |
| 4,049,079 | 9/1977 | Stedman | 182/2 |
| 4,069,637 | 1/1978 | Braithwaite | 182/2 |

*Primary Examiner*—Reinaldo P. Machado
*Attorney, Agent, or Firm*—Webster B. Harpman

[57] ABSTRACT

An extension boom for use with a tractor mounted back hoe assembly comprises a main body section pivotally connected at one end to said back hoe assembly in place of the usual back hoe bucket. The main body section is formed of a pair of spaced elongated channel members with a fixed outwardly extending tubular member therebetween. A secondary tubular member is positioned partially within said tubular member and is telescopically extensible therefrom. The extension is adapted to support an aerial platform for a workman.

6 Claims, 4 Drawing Figures

EXTENSION BOOM FOR TRACTORS HAVING BACK HOE ATTACHMENTS

BACKGROUND OF THE INVENTION (1) Field of the Invention

This invention relates to attachments for back hoes that provide a workman's supporting aerial platform or the like.

(2) Description of the Prior Art

The prior art comprises a number of different devices that provide support platforms in connection with tractors or the like. See for example U.S. Pat. Nos. 3,291,253, 3,448,827 and 3,534,832.

In U.S. Pat. No. 3,291,253, an aerial platform is attached to a tractor front end loader and has limited movement. The present back hoe extension boom attaches directly to the pivoted powered arms of a tractor back hoe attachment in place of the bucket usually used therewith and provides an aerial platform support with a high degree of mobility.

U.S. Pat. No. 3,448,827 relates to a mobile support on an independent machine. The present invention teaches an extension boom that is attached on the existing hydraulically actuated arms of a back hoe attachment on a tractor in place of the usual bucket used therewith.

U.S. Pat. No. 3,534,832 shows a movable aerial platform attached to a tractor using the hydraulic system of the tractor to power piston and cylinder assemblies in the attached device. Applicant's invention is attached to and operated by the pivoted powered arms of the back hoe attachment which in turn is powered by the hydraulic system of the tractor on which the back hoe attachment is mounted.

SUMMARY OF THE INVENTION

A backhoe extension boom and an aerial platform are mounted on the pivoted powered arms of a back hoe attachment for a tractor in place of the usual bucket. The extension boom has a pair of elongated members with a tubular member therebetween. A secondary tubular member is telescopically positioned in said first tubular member and the free end of the extension boom carries an aerial platform and/or a hook for lifting the platform to a desired height and distance from the tractor.

DESCRIPTION OF THE PREFERRED EMBODIMENT

Figure 1:
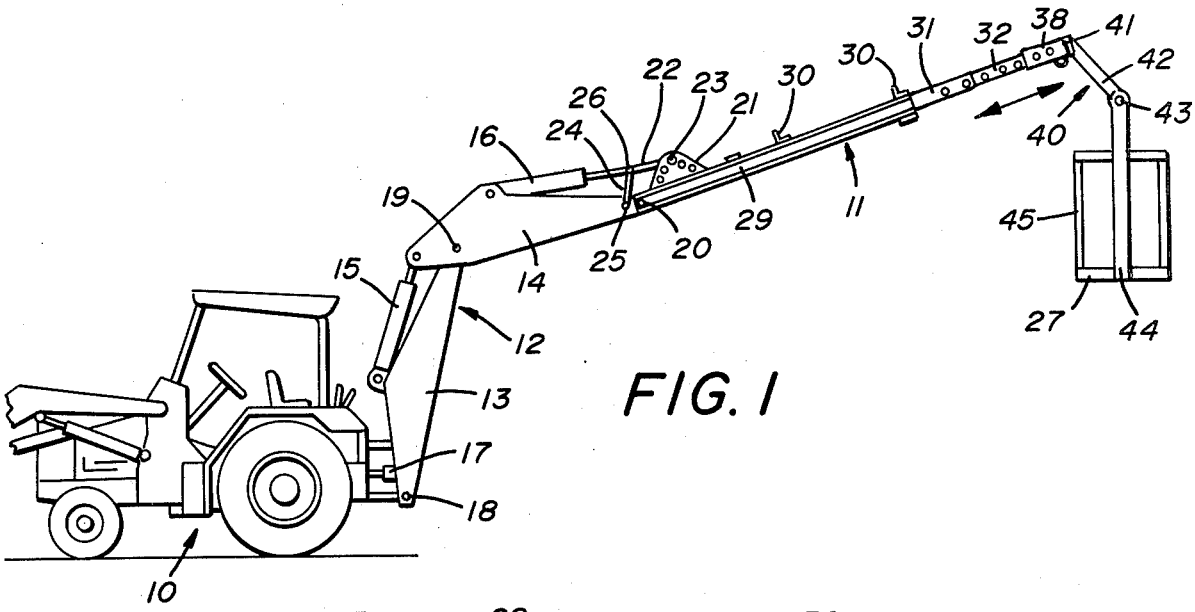
FIG. 1 is a side elevation of a tractor with a back hoe attachment with the boom extension attached thereto.

In FIG. 1 of the drawings a tractor 10 and back hoe attachment 12 is illustrated with the boom extension 11 pivoted to the back hoe attachment 12. The back hoe attachment 12 comprises a pair of pivoted arms 13 and 14 and actuating hydraulic piston and cylinder assemblies 15 and 16 are mounted thereon for moving the same relative to one another as known in the art. Another piston and cylinder assembly 17 mounted on either the tractor 10 or the arm 13 is provided to move the back hoe assembly relative to the tractor 10 in an arc based on a pivot 18. The arm 14 is pivoted to the arm 13 of the back hoe assembly by a pivot 19 and the boom extension 11 is pivoted to the outward end of the arm 14 by a pivot 20. In order that the boom extension 11 may be moved in an arc based on the pivot 20, a pair of apertured plates 21 are mounted on the adjacent end of the boom extension 11 and a first pair of levers 22 are pivoted to the apertured plates 21 by a pivot 23 which is positioned in one of a number of the apertures in the apertured plates 21.

A second pair of levers 24 are pivoted by a pivot 25 to the outer end of the arm 14 of the back hoe attachment 12 and to the inner end of the first pair of levers 22 and to the piston rod of the piston and cylinder assembly 16 by a pivot pin 26.

It will thus be seen that the boom extension 11 replaces the bucket which is usually attached to the outer end of the arm 14 of the back hoe attachment 12.

It will thus be seen that a tractor having a back hoe attachment is capable of being used both as a back hoe by positioning the usual bucket on the end of the arm 14 and as an aerial platform support device by replacing the bucket with the extension boom 11 and attaching a platform such as indicated in FIG. 1 by the numeral 27.

Figure 2:
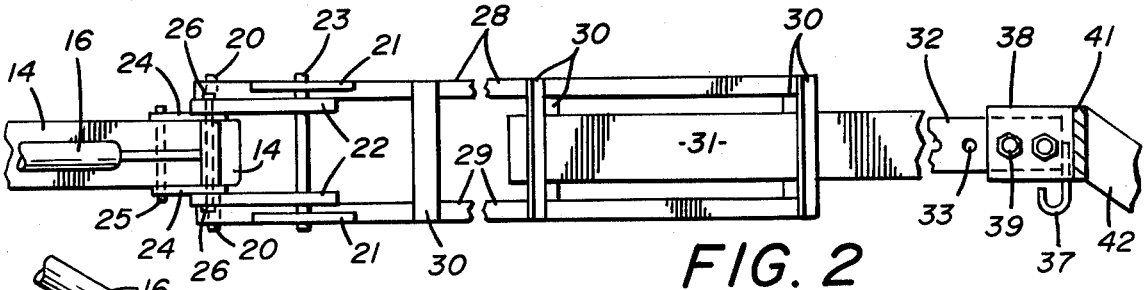
FIG. 2 is a top plan view of the extension boom seen in FIG. 1.
Figure 3:
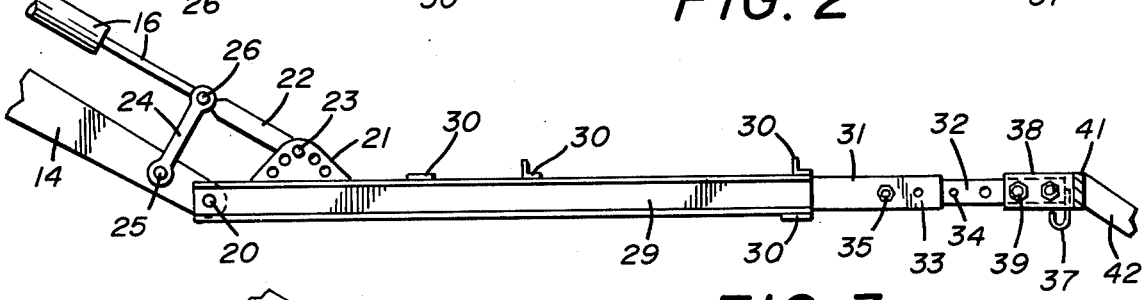
FIG. 3 is a side elevation with parts broken away showing the extension boom and parts of the back hoe attachment.
Figure 4:
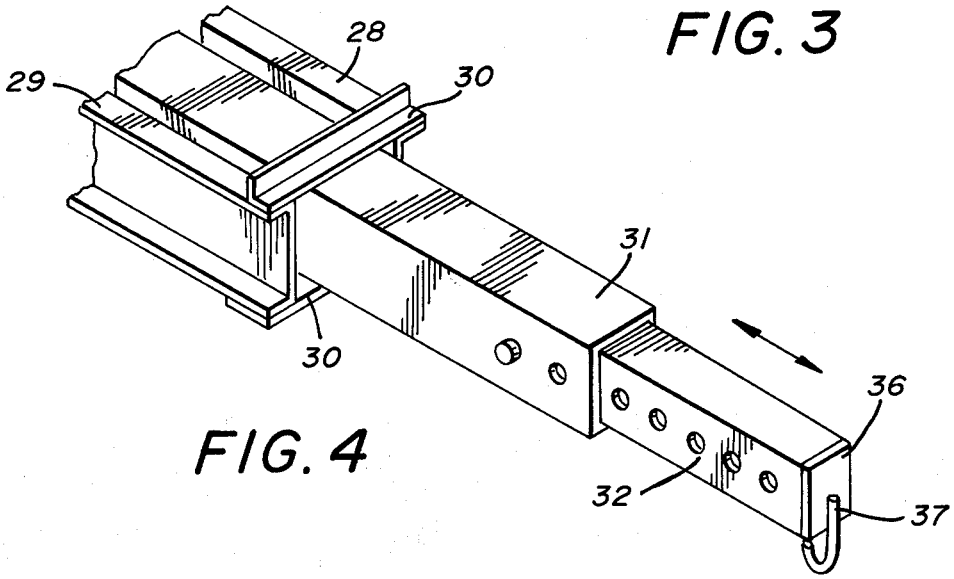
FIG. 4 is a perspective view of the free end portion of the extension boom.

By referring now to FIGS. 2, 3, and 4 of the drawings, it will be seen that the boom extension 11 is comprised of a pair of elongated channel members 28 and 29 held in spaced relation to one another by a plurality of cross members 30 which are attached thereto. The pair of apertured plates 21 are mounted on these elongated channel members 28 and 29 so as to extend vertically and upwardly with respect thereto. The pivot pin 20 which pivotally attaches the extension boom 11 to the back hoe attachment 12 is directly engaged in openings in the elongated channel members 28 and 29 and passes through the outermost end of the arm 14 of the back hoe attachment as best seen in FIGS. 2 and 3 of the drawings.

Still referring to FIGS. 2, 3, and 4 of the drawings, it will be seen that an elongated tubular body member 31 is positioned between the channel members 28 and 29 and attached thereto so as to extend outwardly from the free end thereof (the right end as seen in the drawings). A secondary tubular body member 32 is telescopically positioned partially within the tubular body member 31 and extends outwardly of the free end thereof as seen in FIGS. 3 and 4 of the drawings. Apertures 33 and 34 in the tubular body member 31 and secondary tubular body member 32 are arranged for registry with one another so that the extent of the telescopic relation of the secondary tubular body member 32 to the tubular body member 31 may be fixed as by the use of a pin or a bolt 35.

As best seen in FIG. 4 of the drawings, the outermost or free end of the secondary tubular body member 32 is provided with a closure plate 36 to which a depending hook 37 is attached.

By referring again to FIGS. 1, 2 and 3 of the drawings, it will be seen that a bracket 38 is positioned over the outer end of the secondary tubular member 32 and apertures in the sides of the bracket 38 enable bolts 40 to secure the bracket 38 to the secondary tubular member 32.

The bracket 38 is the base portion of a yoke, generally indicated at 40 and comprising a cross member 41 on the bracket 38 from the opposite ends of which angular arms 42 of the yoke extend.

In FIG. 1 of the drawings, these arms 42 will be seen to be provided with pivots 43 on their lower outer ends to which the upper ends of vertical frame members 44 on the platform 27 are pivotally attached. Additional frame members 45 on the platform 27 form a guard rail, the arrangement being such that a person, such as a workman, standing on the platform 27 will have his upper body portion in the area comprising the space between the lower ends of the spaced arms 42 of the yoke which suspends the aerial platform 27 from the boom extension 11 of the invention.

It will thus be seen that a practical and efficient and relatively inexpensive boom extension for a back hoe attachment on a tractor has been disclosed which enables the back hoe attachment to be used to position the boom extension and an aerial platform carried on the outermost end thereof in almost any desired elevated relation to the tractor. The device is particularly useful in repairing and painting buildings having relatively high side walls and including repair or replacement work on the eaves, eave spouts or the like which are otherwise relatively inaccessible. The provision of the hook 37 on the outermost end of the boom extension makes it possible for the material being used or applied to a building to be attached thereto and elevated by the device at the same time the workman is elevated by the aerial platform 27.

While the present invention has been described by means of specific embodiments, it is to be understood that numerous changes and modifications may be made therein without departing from the spirit and scope of the invention as defined in the appended claims.

What is claimed is:

1. An extension boom for use with a tractor having a back hoe assembly thereon wherein the back hoe assembly has a pair of arms pivoted to one another and wherein one of the arms is pivoted to the tractor and means on the tractor and the arms for moving the same relative to one another, the extension boom being pivotally attached to one of said arms so as to extend outwardly therefrom, said extension boom comprising a pair of elongated body members arranged in spaced parallel relation, a first tubular member secured to the elongated body members and extending outwardly beyond one end thereof, a secondary tubular body member telescopically mounted in said first tubular body member and means for securing said secondary tubular body member in desired relation to the first tubular body member, means on said boom for supporting an article to be moved, apertured attachment plates on said elongated body members located above the axial center line thereof and links selectively engaged in said apertures plates, power means on one of said arms and connected with said links whereby motion imparted by said power means to said apertured plates raises and lowers said boom extension relative to said arms of said back hoe assembly.

2. The extension boom for use with a tractor having a back hoe assembly mounted thereon as set forth in claim 1 and wherein a yoke of inverted U-shape in cross section is positioned over and in registry with said secondary tubular body member and wherein portions of the yoke are angularly disposed with respect to said mounting bracket, pivotal means on the outer ends of said angularly disposed portions and an aerial platform suspended therefrom.

3. The extension boom for use with a tractor having a back hoe assembly thereon as set forth in claim 1 and wherein said power means on one of said arms comprises a piston and cylinder assembly and wherein said power means is controlled from said tractor.

4. The extension boom for use with a tractor having a back hoe assembly thereon as set forth in claim 1 and wherein the first tubular member is positioned between said spaced elongated body members for a portion of its length with the majority of its length extending beyond said elongated body members.

5. The extension boom for use with a tractor having a back hoe assembly as set forth in claim 1 and wherein said means on the tractor and the arms for moving the same relative to one another comprise hydraulic piston and cylinder assemblies, one positioned between said tractor and one of said arms and the other positioned between one of said arms and the other of said arms at points spaced with respect to the pivotal engagement of said arms.

6. The extension boom for use with a tractor having a back hoe assembly thereon as set forth in claim 1 and wherein the first tubular body member is of substantially square cross section and the secondary tubular body member telescopically mounted in said first tubular body member is of substantially square cross section and wherein said pair of elongated body members comprise channel-shaped members with the flanges outturned with respect to one another and spaced in parallel relation sufficiently to receive said first tubular member therebetween.

* * * * *